United States Patent [19]

Marchaj

[11] 4,249,352

[45] Feb. 10, 1981

[54] EARTHQUAKE RESISTANT TANK

[75] Inventor: Tadeusz J. Marchaj, Pt. Washington, N.Y.

[73] Assignee: Preload Technology, Inc., Garden City, N.Y.

[21] Appl. No.: 906,332

[22] Filed: May 16, 1978

[51] Int. Cl.[3] ..... E02D 27/34

[52] U.S. Cl. ..... 52/167; 52/152; 52/226; 52/247

[58] Field of Search ..... 52/225, 223 R, 167, 52/247, 245, 146, 152, 248, 249, 226

[56] References Cited

U.S. PATENT DOCUMENTS

| | | | |
|---|---|---|---|
| 1,166,987 | 1/1916 | Hedrick | 52/247 X |
| 1,167,790 | 1/1916 | Benson | 52/226 X |
| 1,220,227 | 3/1917 | Houff | 52/152 X |
| 1,400,251 | 12/1921 | Cotf | 52/226 X |
| 2,193,380 | 3/1940 | Prize | 52/245 |
| 4,069,642 | 1/1978 | Hendriks | 52/247 X |

*Primary Examiner*—Carl D. Friedman

*Attorney, Agent, or Firm*—Curtis, Morris & Safford

[57] ABSTRACT

A tank adapted to withstand the horizontal displacement forces and overturning moments which act upon the side walls thereof under earthquake conditions is disclosed. The tank includes a base and cylindrical side walls and a plurality of tendons are provided each of which is attached to the cylindrical side wall at one end and to an anchor fixedly positioned in the concrete base. Each of the tendons is stressed and the stress in the tendon acts downwardly and in some embodiments radially outwardly on the tank wall and substantially restrains the wall from horizontal displacement and protects the side walls from the stresses developed due to the overturning moment. Steel-wall and prestressed concrete wall tanks, particularly for cryogenic liquids, can be adapted according to the invention.

A double-wall storage tank for cryogenic liquids is also shown wherein a plurality of stressed tendons are distributed around the inner wall and act outwardly and downwardly on the upper portion of the inner wall and wherein a second plurality of stressed tendons are attached to the upper part of the outer wall and act inwardly and downwardly thereupon.

9 Claims, 6 Drawing Figures

FIG. 3
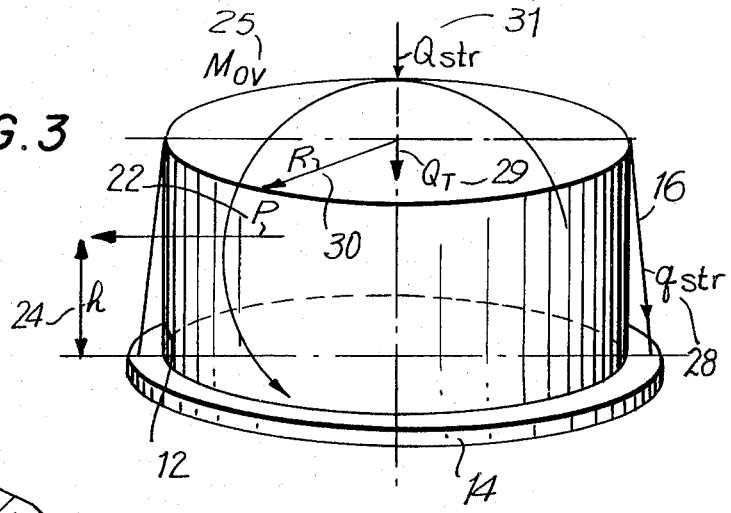
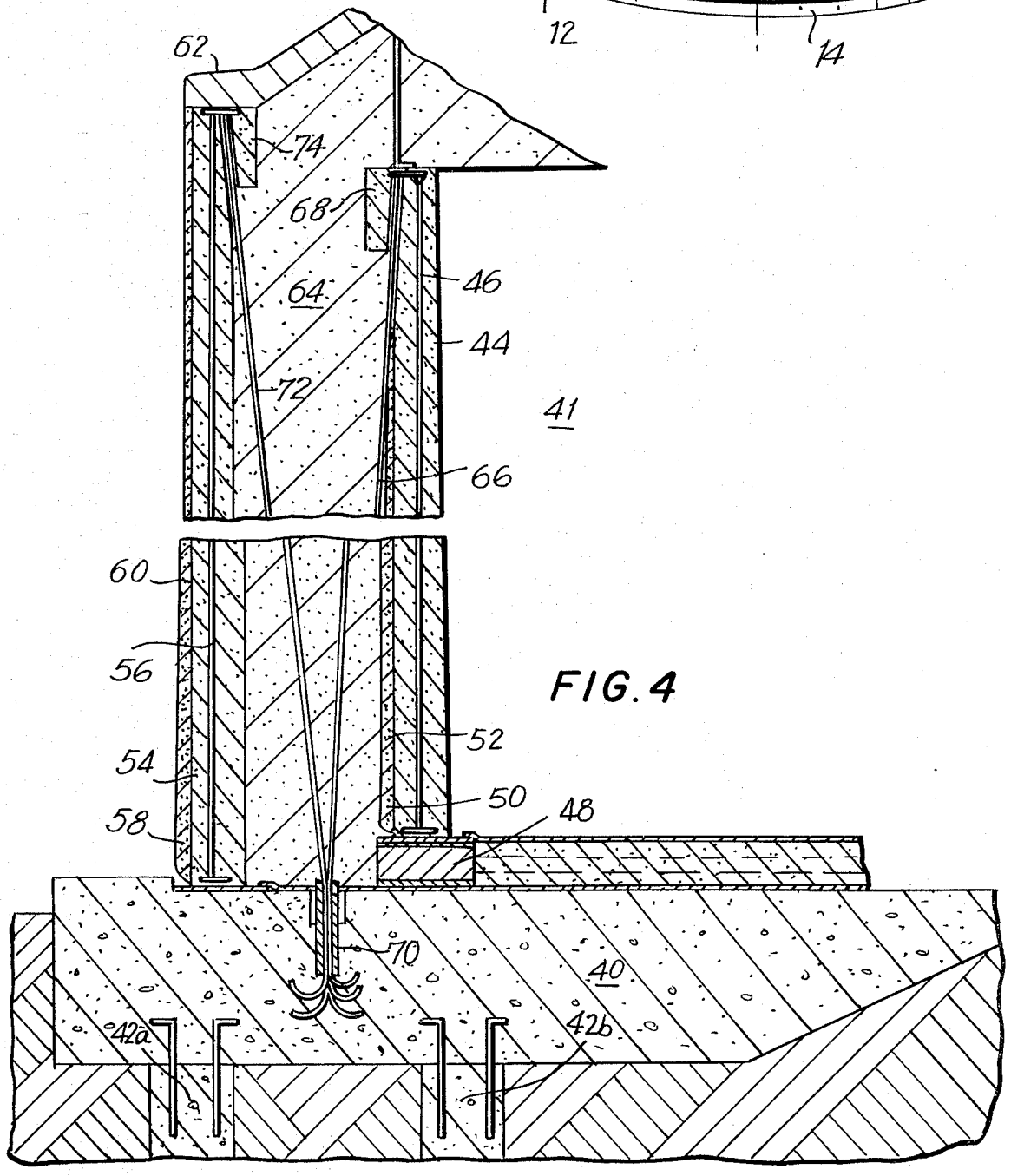
FIG. 4

EARTHQUAKE RESISTANT TANK

This application relates to storage tanks for the storage of solids and liquids and more particularly to tanks adapted to withstand earthquake conditions. Even more specifically, this application relates to liquid natural gas tanks of single-wall and double-wall construction having prestressed tendons connected thereto to assist the tank in withstanding horizontal displacement forces and overturning moments which occur during earthquake conditions.

The problem of designing tanks so that they withstand earthquake loadings has long confronted the art. In particular, the problems of designing liquid natural gas tanks to withstand the peculiar and unique loads which occur during earthquakes has not been satisfactorily solved.

It is known, for example, to stiffen tanks by attaching vertical anchor straps to the sides thereof and securing these in a concrete base for the tank, as shown in U.S. Pat. No. 3,562,986. This design is inadequate to protect the tank from the stresses caused by an earthquake because it is necessary for the tank to actually be displaced horizontally and vertically and to suffer some overturning displacement before a restraining force is developed in the anchor straps. It is also known to use tensioned guys in connection with tanks as shown, for example, in U.S. Pat. No. 2,386,958. This design is also inadequate to protect the tank from the stresses caused by an earthquake because the tendons are not attached to the base and their main purpose is to add stability to the supporting structure, not to provide an initial restraint against earthquake forces.

It is understood that earthquake forces in the environs of a liquid-containing tank generate horizontal and vertical forces on the tank. The horizontal acceleration of a tank generates dynamic forces within the contained solid or liquid which act outwardly on one side of the tank and inwardly on the opposite side. The result is a net force, acting horizontally, which tends to move the tank in a horizontal direction and create a horizontal shear at a section above the bottom of the tank. Since the horizontal force acts at some distance above the bottom it thereby creates an overturning moment as well.

While the overturning moment is to some extent counteracted by a stabilizing moment due to the weight of the tank structure, under certain earthquake conditions this stabilizing moment is insufficient, and potentially dangerous tensile and compressive stresses may develop in the tank walls. The compressive stresses develop in the tank wall on the side that resists the horizontally acting force and tensile stresses develop in the opposite wall. In these circumstances it is necessary to provide external means for stabilizing the tanks and typically anchor straps are used as shown in U.S. Pat. No. 3,562,986. However, the problems discussed above remain and the tank is still vulnerable to damage under earthquake conditions.

Because the direction of the horizontal force due to earthquake is unknown, and may be from any direction, it has also been necessary to distribute anchor straps around the entire base of the wall of steel tanks in particular. The large number of anchor straps provide a fairly great cross section and where cryogenic liquids are being stored these anchor straps provide a significant heat influx into the tank and create thermal problems in the tank foundation.

It is thus a primary object of this invention to improve the integrity of liquid-or solid-containing tanks under earthquake conditions.

It is a further and related object of this invention to reduce the tendency for such tanks to displace horizontally or to overturn and to mitigate the stresses caused by those forces and moments, respectively, due to earthquake conditions.

It is another related object of this invention to improve the safety of such tanks and to avoid the failures of prior art tank configurations by preventing any displacement or overturning of tanks due to earthquake conditions.

It is a related object of this invention to minimize the heat influx to a cryogenic liquid storage tank contributed by anchor straps or the like as used in prior art designs.

These and other objects of the invention are achieved by adapting a stationary tank which includes a base and side walls for containing liquids or solids with at least one and, in substantially all embodiments, a plurality of tendons, which are positioned and prestressed to restrain a side wall from horizontal displacement and to mitigate the vertical stresses therein caused by earthquake conditions. The tendons act to artificially increase the weight of the tank and thereby increase the stabilizing moment which must be higher than the overturning moment during earthquake conditions. The prestressed tendon is connected at one end to a side wall and at the other end to a fixed anchor. Typically, the base of the tank comprises a concrete footing which extends beneath the tank floor and horizontally outwardly of the side walls and the anchor for the prestressed tendon is fixedly positioned in the concrete footing.

The invention has particular application to tanks which include a concrete base, a vertically-positioned cylindrical side wall and a roof. Such tanks are provided with a plurality of prestressed tendons, each of which tendons is affixed at one end to the cylindrical side wall and at the other end to an anchor which is fixedly positioned in the concrete base at a point horizontally spaced from the side wall. Each of the tendons is stressed. Desirably, each of the plurality of tendons is affixed to an upper part of the cylindrical side wall at a separate connection place and each of the connections are spaced from one another in equal angular increments around the circumference of the cylindrical tank wall. The height of the connection of the prestressed tendon to the cylindrical side wall is determined according to the possible earthquake forces which may be encountered and the details of construction of the tank. Steel tanks will have a connection lower on the cylindrical side wall than prestressed concrete tanks, because of the possibility of the buckling of the thin steel shell in its upper part.

A plurality of tendons may be affixed to a single anchor or desirably each tendon may be affixed to a separate anchor which is fixedly positioned in the concrete base in equal angular increments around the circumference of the tank and horizontally outwardly of the cylindrical side wall. However, the tendons may also be affixed to anchors around the circumference of the tank and positioned horizontally inwardly of the cylindrical side wall.

In the preferred embodiments described in connection with the drawings, the invention is used to adapt a stationary tank for the storage of liquids or solids, having a concrete base, a vertically-positioned, cylindrical side wall of prestressed concrete on the base and a roof. The plurality of prestressed tendons are connected at one end to the upper part of the cylindrical side wall and at the other end to anchors fixedly positioned in the concrete base at a point radially displaced from the connection between tendon and side wall and the plurality of tendons is equally distributed around the circumference of the tank. The anchors may be positioned radially inwardly or outwardly of the connection between tendon and side wall and desirably the tendons include means for varying the tension therewithin.

The invention can be applied to double-wall storage tanks for cryogenic liquids. Such double-wall tanks include an inner wall as described above and an outer cylindrical side wall of prestressed concrete, in addition. The inner and outer walls are separated by insulation. A first plurality of prestressed tendons is equally distributed around the outer circumference of the inner wall and each of the tendons is connected at one end to a separate upper part of the inner wall and at the outer end to a separate anchor fixedly positioned in the concrete base at a point radially outwardly of the point at which the tendon is connected to the inner wall and radilly inwardly of the outer wall. A second plurality of prestressed tendons is equally distributed around the inner circumference of the outer wall, each of the tendons being connected at one end to a separate upper part of the outer wall and at the other end to a separate anchor fixedly positioned in the concrete base at a point radially inwardly of the point at which the tendon is connected to the outer wall and radially outwardly of the inner wall.

The invention is further described in connection with the drawings.

IN THE DRAWINGS

FIG. 3 is a schematic drawing indicating several of the forces upon the tank of FIG. 1 under earthquake loading conditions;

FIG. 4 is a cross-section view of a double-wall liquid natural gas tank adapted according to the invention;

Figure 1:
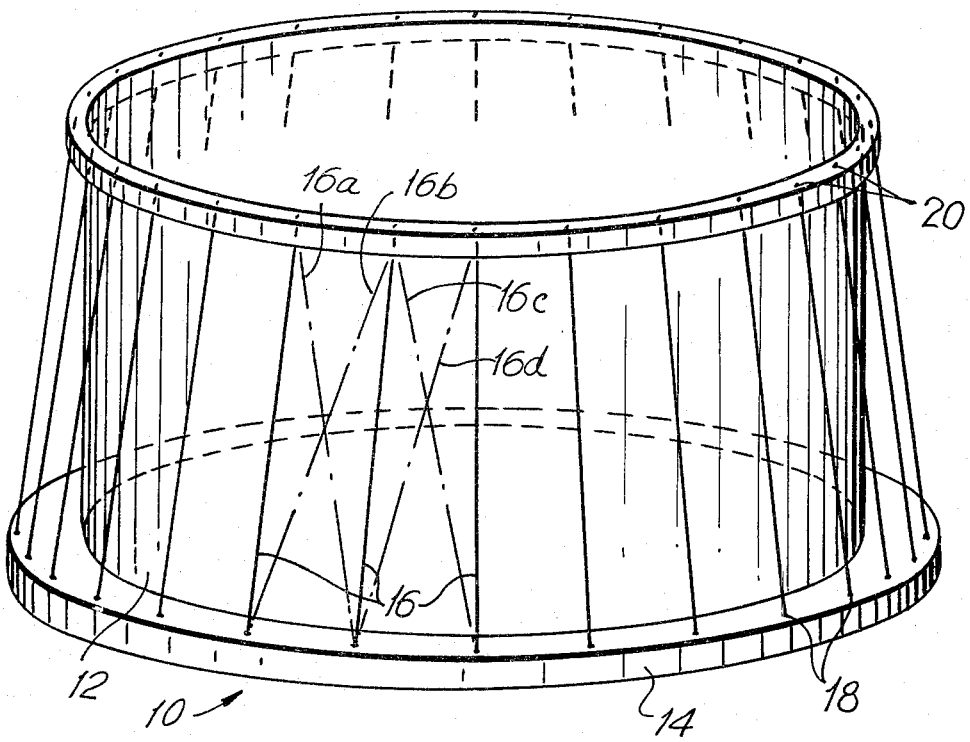
FIG. 1 is a schematic representation of a cylindrical concrete tank adapted according to the invention.

Turning to FIG. 1, reference numeral 10 identifies a cylindrical tank adapted according to the invention. Tank 10 includes cylindrical wall 12 which is erected on concrete base 14 which extends horizontally outwardly of the circumference of cylindrical wall 12. Reference numeral 16 identifies a plurality of prestressed steel tendons which are anchored at their lower ends 18 in concrete base 14 and which are connected at connection points 20 along the upper and outer side of cylindrical wall 12. As will be apparent to those skilled in the art, tendons 16 may be substantially radial of the tank 10 as shown or may cross as shown by dotted lines 16*a, b, c* and *d* or may be in other configurations as dictated by design considerations.

Figure 2:
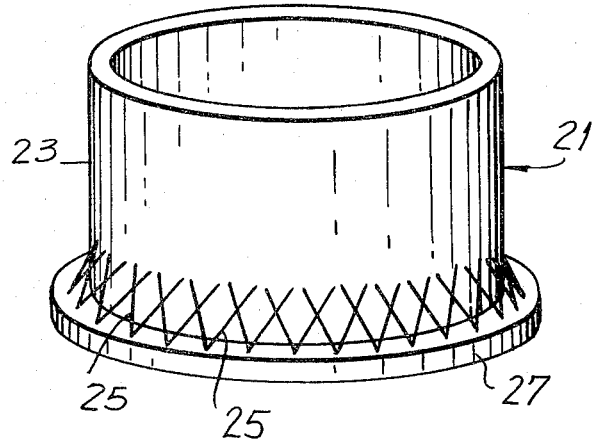
FIG. 2 is a schematic representation of a cylindrical steel tank adapted according to the invention.

FIG. 2 depicts a steel tank 21 having a steel, cylindrical side wall 23. Attached to wall 23 are a plurality of tendons 25 which extend outwardly of wall 23 in a crisscross configuration and which are anchored in base 27. All of tendons 25 are stressed in accordance with the invention.

Turning to FIG. 3, reference numerals 12, 14 and 16 refer to the cylindrical side wall, concrete base and prestressed tendons, respectively, as discussed in connection with FIG. 1. Reference numeral 22 identifies the force P exerted in a horizontal direction against the left side of cylindrical wall 12 due to the horizontal acceleration caused by movements of the earth under earthquake conditions. Force P acts at a height identified by "h", reference numeral 24, above the base 14 of the tank. Reference numeral 26 identifies the overturning moment Mov to which the tank is subjected due to the earthquake forces. Reference numeral 28 identifies the vertical tension force $q_{str.}$ in prestressed tendon 16; reference numeral 29 identifies the weight of the tank $Q_T$; and reference numeral 31 identifies the total downward force from the tendons.

As will be understood by those skilled in the art, the tension in prestressed tendon 16 can be adjusted so as to restrain cylindrical side wall 12 from horizontal displacement due to horizontal force P and likewise to mitigate the compressive stresses developed in the left side of cylindrical wall 12 and the tensile stresses developed in the right side of cylindrical wall 12 due to overturning moment $M_{ov}$. The amount of tension in tendon 16 and the number of tendons is a function of the size and geometry of the tank, the weight of liquid contained therein, the configuration and weight of the side walls, etc., as will be well understood by those skilled in the art. Thus, it will be understood that the overturning moment $M_{ov}$ is Pxh and the stabilizing moment $M_{stab}$ is $(Q_T+Q_{str})R$ where R is the radius of the tank and n is the number of strands and that proper design must ensure that $M_{stab}>M_{ov}$.

Turning to FIG. 4, a double-wall, storage tank for cryogenic liquids is shown there which is adapted to withstand horizontal displacement forces and overturning moments acting upon the side walls thereof under earthquake conditions. Reference numeral 40 identifies a concrete base upon which prestressed concrete inner wall 44 and prestressed concrete outer wall 54, respectively, are erected in substantially vertical, cylindrical configuration. Both inner wall 44 and outer wall 54 have vertical, prestressed tendons 46 and 56, respectively, as well as circumferential prestressing tendons 50 and 58, respectively, as is known in the art. Reference numerals 52 and 60 identify the mortar covering the circumferential prestressed tendons 50 and 58, respectively. Reference numeral 48 identifies insulation blocks upon which cylindrical inner wall 44 is mounted. Reference numeral 62 identifies a roof structure which spans the space enclosed by outer wall 54. The annular space between inner wall 44 and outer wall 54 is filled with an insulating material such as perlite 64. Reference numeral 41 identifies the cryogenic liquid contained within the space defined by inner cylindrical wall 44 and reference numerals 42*a* and 42*b* identify pilings beneath base 40 for protecting the double-wall tank from extremely great earthquake loads.

In order to restrain inner wall 44 from horizontal displacement and vertical stresses under earthquake loading conditions, a plurality of prestressing tendons 66 are distributed around the circumference of inner wall 44, substantially as shown in FIG. 1. The prestressing tendons are equally distributed in angular increments around the circular circumference of the inner wall. Each prestressing tendon 66 is connected at its upper end to a connector 68 which is fixed to the upper part of inner cylindrical side wall 44 on the outer surface thereof. The lower part of each of the prestressed tendons 66 is fixed in an anchor 70 set in concrete base 40 at a position outwardly of inner wall 44 and inwardly of outer wall 54. The stress in tendon 66 therefore acts radially outwardly on connector 68 as well as downwardly.

Attached to outer wall 54 are a plurality of prestressed tendons 72 which are in turn connected at equal angular increments around the circular circumference of outer wall 54 by means of connectors 74. The prestressed tendons 72 are attached at their lower end to anchor 70, as described above, and exert their force radially inwardly as well as downwardly on connectors 74.

Figure 5:
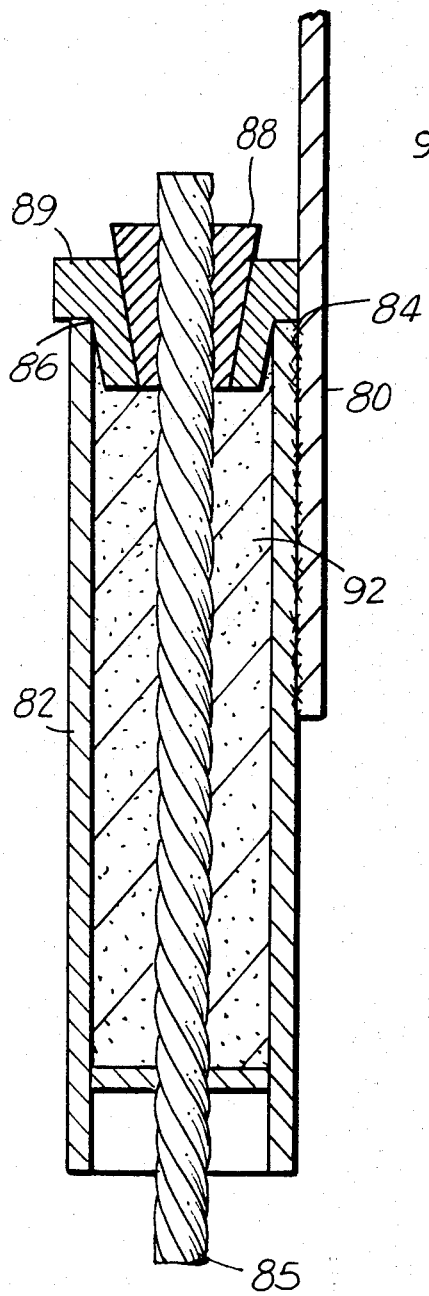
FIG. 5 is a cross-section view of a detail of a typical connection between prestressing tendon and a steel tank wall according to the invention.

Means for connecting the prestressed tendons to inner wall 44 and outer wall 54 by means of connectors 68 and 74, respectively, are well known in the art. A typical connection is shown in FIG. 5 for a steel wall tank. Reference numeral 80 identifies the steel wall and reference numeral 82 identifies a steel pipe which is welded at 84 to steel wall 80. The prestressed tendon 85 is retained in pipe 82 by means of anchor element 86 which includes, for example, an annular wedge-shaped gripper 88 which is retained in anchor plate 89. The space within pipe 82 is filled with a grouting or bonding material 92 to secure the anchor elements. In setting the tendons 84 within steel pipe 82, the tendon is anchored to the base, then stressed to a predetermined tension value by hydraulic jacks and the annular wedges 88 are seated to provide a positive, non-slip, fixed-end anchorage.

Figure 6:
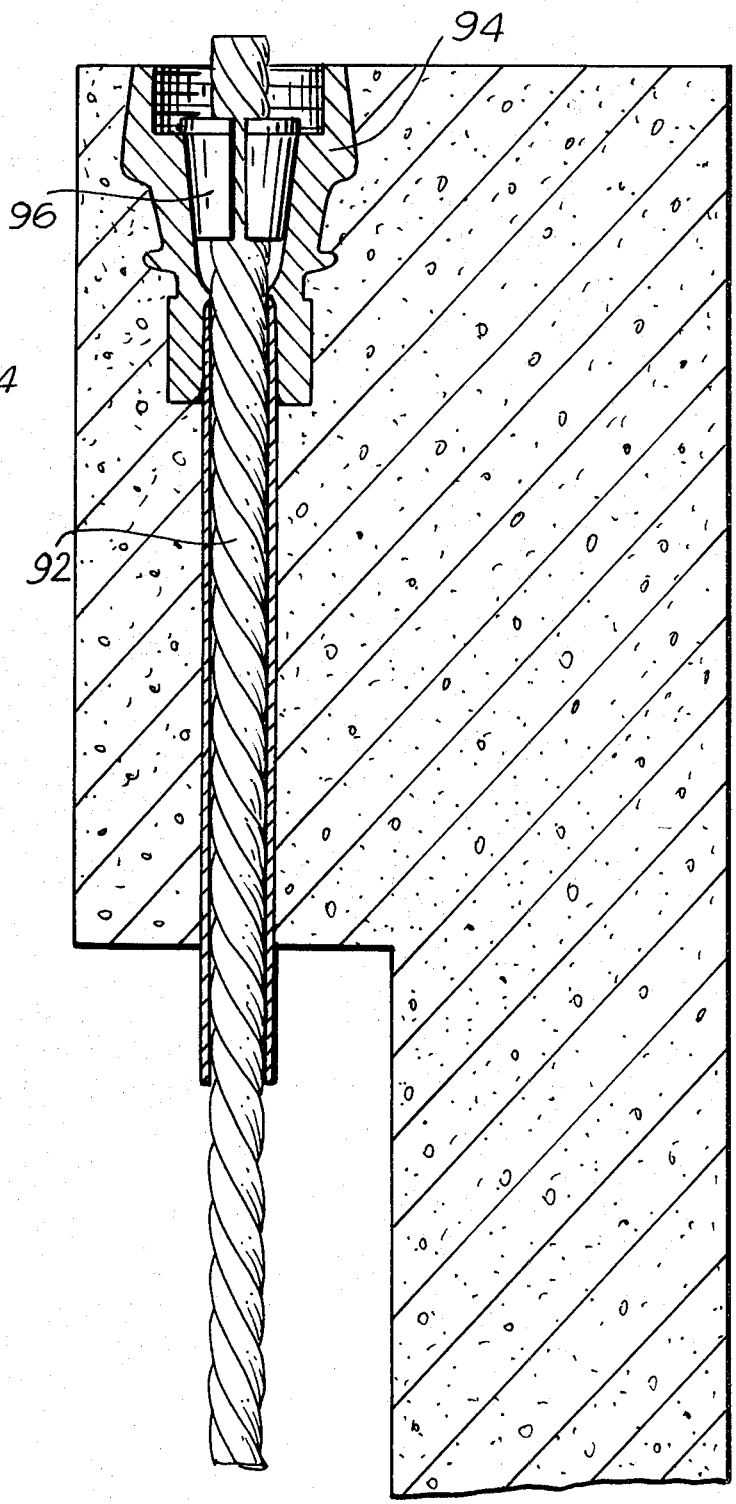
FIG. 6 is a detailed view of a concrete anchor employed according to the invention.

In FIG. 6, which refers to a concrete wall tank, reference numeral 93 identifies a seven-strand conventional tendon, reference numeral 94 identifies an anchor collar through which tendon 93 passes and reference numeral 96 identifies a wedge-shaped grip which tightly grips tendon 93 and seats within anchor collar 94.

What is claimed is:

1. A stationary tank of improved structural integrity for the storage of liquids or solids adapted to withstand forces acting upon the side walls thereof under earthquake conditions, including a concrete base; a vertically-positioned cylindrical side wall; and a plurality of tendons each tendon being stressed and each tendon being affixed at one end to said cylindrical side wall and at the other end to an anchor fixedly positioned in said concrete base at a position radially displaced from said side wall, so that said tendons each slope generally radially and downwardly from said side wall to said anchor and the stress in each said tendon has a radial as well as a vertical component to restrain said side walls from horizontal displacement and to mitigate the vertical stresses caused by earthquake conditions.

2. A stationary tank as recited in claim 1, wherein each of said plurality of tendons is affixed to said upper part of said cylindrical side wall at a separate connection, said connections being spaced from one another in equal angular increments around the circumference of said tank.

3. A stationary tank as recited in claim 1, wherein each of said tendons is anchored in said concrete base at angular increments around the circumference of said tank and outwardly of said cylindrical side wall.

4. A stationary tank of improved structural integrity for the storage of liquids or solids adapted to withstand forces acting upon the side walls thereof under earthquake conditions, including a concrete base; a vertically-positioned cylindrical side wall; and a plurality of tendons, wherein each of said tendons is affixed to an upper part of said cylindrical side wall at a connection, said connections being spaced from one another in equal angular increments around the circumference of the tank, and wherein each tendon is also anchored in said concrete base at angular increments around the circumference of said tank and at a position displaced radially inwardly of said cylindrical side wall, said tendons serving to restrain said side walls from horizontal displacement and to mitigate the vertical stresses caused by earthquake conditions.

5. A stationary storage tank of improved structural integrity for the storage of cryogenic liquids adapted to withstand forces acting upon the side walls thereof under earthquake conditions, comprising a concrete base; a vertically-positioned, cylindrical side wall of prestressed concrete upon said base; a roof; and a plurality of tendons, each of said tendons being stressed and being connected at one end to an upper part of said cylindrical side wall and at the other end to an anchor fixedly positioned in said concrete base, wherein said anchors are positioned radially inwardly of said connection between tendon and side wall, said tendons serving to restrain said side walls from horizontal displacement and to mitigate the vertical stresses caused by earthquake conditions.

6. A tank as recited in claim 5, including means associated with said tendons for varying the tension therewithin.

7. A stationary, double-wall, storage tank for cryogenic liquids adapted to withstand forces acting upon the side walls thereof under earthquake conditions, having a concrete base; an inner, vertical cylindrical side wall of prestressed concrete on said base; an outer, vertical, cylindrical side wall of prestressed concrete on said base positioned concentrically to and outwardly of said inner wall, said inner and outer walls being separated by insulation; and a roof; and further including, a first plurality of prestressed tendons equally distributed around the outer circumference of said inner wall, each of said tendons being connected to one end to an upper part of said inner wall and at the outer end to an anchor fixedly positioned in said concrete base at a point outwardly of the point at which the said tendon is connected to said inner wall and inwardly of said outer wall; and a second plurality of prestressed tendons equally distributed around the inner circumference of said outer wall, each of said tendons being connected to one end to an upper part of said outer wall and at the other end to an anchor fixedly positioned in said concrete base at a point inwardly of the point at which the said tendon is connected to said outer wall and outwardly of said inner wall.

8. A stationary tank of improved structural integrity for the storage of liquids or solids and adapted to withstand forces acting upon the side walls thereof under earthquake conditions, including a base; a vertically-positioned cylindrical side wall; and a plurality of tendons, each tendon being stressed and each tendon being affixed at one end to said cylindrical side wall at a point a vertical predetermined distance from said base substantially less than the height of said cylindrical side wall, and at the other end to an anchor fixedly positioned in said base at a position radially displaced from said side wall so that said tendons each slope generally radially and downwardly from said side wall to said anchor and the stress in each tendon has a radial as well as a vertical component to restrain said side walls from horizontal displacement and to mitigate the vertical stresses caused by earthquake conditions.

9. A stationary tank as recited in claim 8, wherein said vertical predetermined distance is determined according to the possible earthquake forces which may be encountered and the details of construction of the tank.

* * * * *